US005207193A

United States Patent [19]

Sugimoto et al.

[11] Patent Number: 5,207,193

[45] Date of Patent: May 4, 1993

[54] VALVE OPERATING SYSTEM IN INTERNAL COMBUSTION ENGINE

[75] Inventors: Chihaya Sugimoto; Yoshihito Tsuji, both of Saitama, Japan

[73] Assignee: Honda Giken Kogyo Kabushiki Kaisha, Tokyo, Japan

[21] Appl. No.: 939,059

[22] Filed: Sep. 2, 1992

[30] Foreign Application Priority Data

Sep. 4, 1991 [JP] Japan ..... 3-224384

[51] Int. Cl.[5] ..... F01L 1/04; F01L 1/34

[52] U.S. Cl. ..... 123/90.27; 123/90.16; 123/308; 123/432

[58] Field of Search ..... 123/90.15, 90.16, 90.27, 123/90.39, 90.41, 90.44, 308, 432

[56] References Cited

U.S. PATENT DOCUMENTS

| | | | |
|---|---|---|---|
| 4,662,323 | 5/1987 | Moriya | 123/90.27 |
| 4,741,302 | 5/1988 | Oda et al. | 123/90.27 |
| 4,844,022 | 7/1989 | Konno | 123/90.16 |
| 4,995,352 | 2/1991 | Machino | 123/90.27 |
| 5,060,605 | 10/1991 | Yamazaki | 123/90.27 |
| 5,095,859 | 3/1992 | Iwata et al. | 123/90.27 |
| 5,101,778 | 4/1992 | Fukuo et al. | 123/90.27 |
| 5,127,380 | 7/1992 | Morishita | 123/90.27 |

FOREIGN PATENT DOCUMENTS

| | | | |
|---|---|---|---|
| 2193998 | 2/1988 | United Kingdom | 123/90.27 |

*Primary Examiner*—E. Rollins Cross
*Assistant Examiner*—Weilun Lo
*Attorney, Agent, or Firm*—Lyon & Lyon

[57] ABSTRACT

A valve operating system in an overhead cam type multicylinder internal combustion engine having three intake-side rocker arms disposed to operate a pair of intake valves and two exhaust-side rocker arms disposed to operate a pair of exhaust valves. The intake-side rocker arms are provided with a connection switchover mechanism capable of switching-over the connection and disconnection of the adjacent in take-side rocker arms. Exhaust-side cams are provided on a cam shaft on opposite sides of intake-side cams which are provided adjacent one another. Two of the intake-side rocker arms and both of the exhaust-side rocker arms are in rolling contact with the corresponding cams through rollers mounted on the rocker arms. The exhaust-side a rocker arms are provided with notches in the area near the cam shaft for accommodating portions of the intake-side rocker arms, respectively. Thus, it is possible to reduce the loss of valve operational friction to the utmost, to position the rocker arms in an axially compact arrangement and to position the intake valves and exhaust valves at a small angle.

9 Claims, 6 Drawing Sheets

VALVE OPERATING SYSTEM IN INTERNAL COMBUSTION ENGINE

BACKGROUND OF THE INVENTION

1. Field of the Invention

The present invention relates to a valve operating system for a multicylinder internal combustion engine having a single overhead camshaft above the cylinders with three intake cams engaging three intake rocker arms that are selectively coupled and uncoupled for operating two intake valves and two exhaust cams engaging two exhaust rocker arms that operate two exhaust valves for each cylinder.

2. Description of the Prior Art

A valve operating system for an internal combustion engine is already known, for example, from Japanese Patent Application Laid-open No. 57806/88, which comprises first, second and third intake-side cams and first and second exhaust-side cams for each cylinder all provided on a single overhead cam shaft, first and second intake-side rocker arms operatively connected independently to a pair of intake valves for each cylinder and a third intake-side rocker arm disposed between the first and second intake-side rocker arms, which arms are swingably carried on an intake-side rocker shaft in engagement with the first, second and third intake-side cams, respectively, first and second exhaust-side rocker arms operatively connected independently to a pair of exhaust valves for each cylinder and swingably carried on an exhaust-side rocker shaft in engagement with the first and second exhaust-side cams, respectively, and a connection switchover mechanism provided on the intake-side rocker arms capable of switching-over the connection and disconnection of the adjacent intake-side rocker arms.

In the above-described prior art valve operating system, however, the intake-side rocker arms are disposed adjacent one another in a section where the connection switchover mechanism is provided, but cams for the intake-side rocker arms and cams for the exhaust-side rocker arms are provided on the cam shaft adjacent one another in an axial direction. Therefore, the intake-side rocker arms cannot be disposed in a compact arrangement, resulting in an increase in size of even the connection switchover mechanism and an increase in weight of the intake-side rocker arms, and resulting in difficulty maintaining the dimensional accuracy of the connection switchover mechanism.

As a result, the present applicant has already proposed a valve operating system (in Japanese Patent Application Laid-open No. 1405/92) in which the exhaust-side rocker arms are disposed on opposite sides of the three intake-side rocker arms in a position corresponding to the cam shaft, thereby providing a compact arrangement of the valve operating system. In this proposed technique, two or all of the three intake-side rocker arms are in direct sliding contact with the cams on the cam shaft whereby there is a significant friction loss in the valve operating system. In order to reduce the loss by friction, each of the intake-side rocker arms may be put into contact with the cam through a roller for a low-friction rolling contact. However, if the roller is supported by a pin on the intake-side rocker arm, the width of the intake-side rocker arm along the axis of the cam shaft in such roller area is relatively large, and the space for the rocker arms is large in a direction along the axis of the cam shaft. This is not desirable from the viewpoint of a compact arrangement of the engine.

In addition, from the view point of an improvement in combustibility of the engine, it is desirable that the angle formed by axes of the intake valves and the exhaust valves projected on a plane including an axis of the cylinder is small. However, if the interference of the intake-side rocker arms and the exhaust-side rocker arms is avoided to provide a reduction in such angle, the space for the rocker arms may be increased in the direction along the axis of the cam shaft, again resulting in difficulty in disposing the rocker arms in a compact arrangement.

SUMMARY OF THE INVENTION

Accordingly, it is an object of the present invention to provide a valve operating system in an internal combustion engine, wherein the loss of valve-operating friction is reduced to the utmost, and it is possible both to dispose the rocker arms in a compact arrangement and to dispose the intake valve and the exhaust valves at a small angle.

To achieve the above object, according to the present invention, there is provided a valve operating system for a multicylinder internal combustion engine, comprising first, second and third intake-side cams and first and second exhaust-side cams for each cylinder all provided on a single cam shaft, first and second intake-side rocker arms operatively connected independently to a pair of intake valves for each cylinder and a third intake-side rocker arm disposed between the first and second intake-side rocker arms, which arms are swingably carried on an intake-side rocker shaft in engagement with the first, second and third intake-side cams, respectively, first and second exhaust-side rocker arms operatively connected independently to a pair of exhaust valves for each cylinder and swingably carried on an exhaust-side rocker shaft in engagement with the first and second exhaust-side cams, respectively, and a connection switchover mechanism provided on the intake-side rocker arms capable of switching-over the connection and disconnection of the adjacent intake-side rocker arms, wherein the first to third intake-side cams are provided adjacent one another in an axial direction on the cam shaft, the first, second and third intake-side rocker arms are disposed between the first and second exhaust-side cams, and at least two of the first, second and third intake-side rocker arms, as well as the first and second exhaust-side rocker arms are put in rolling contact with each of the corresponding cams through rollers, the first and second exhaust-side rocker arms being provided with notches for accommodating portions of the first and second intake-side rocker arms, respectively.

With the above construction, it is possible to provide a reduction in loss of valve-operating friction by the rollers, to dispose the intake valves and the exhaust valves at a small angle to improve the combustibility and further to dispose the rocker arms in a compact arrangement.

In addition to the above construction, if the second intake-side cam corresponding to the second intake-side rocker arm is provided with a reduced width in an axial direction to have an outer surface substantially circular about an axis of the cam shaft, if the second intake-side rocker arm includes a notch provided therein for accommodating a portion of the second exhaust-side rocker arm, and if the slipper on that rocker arm is provided with a small width to come into direct sliding contact with the second intake-side cam, a more compact disposition of the rocker arms is possible.

The above and other objects, features and advantages of the invention will become apparent from the following description of the preferred embodiments, taken in conjunction with the accompanying drawings.

BRIEF DESCRIPTION OF THE DRAWINGS

The drawings illustrate a preferred embodiment of the present invention, wherein.

DESCRIPTION OF THE PREFERRED EMBODIMENTS

The present invention will now be described by way of a preferred embodiment in connection with the accompanying drawings.

Figure 1:
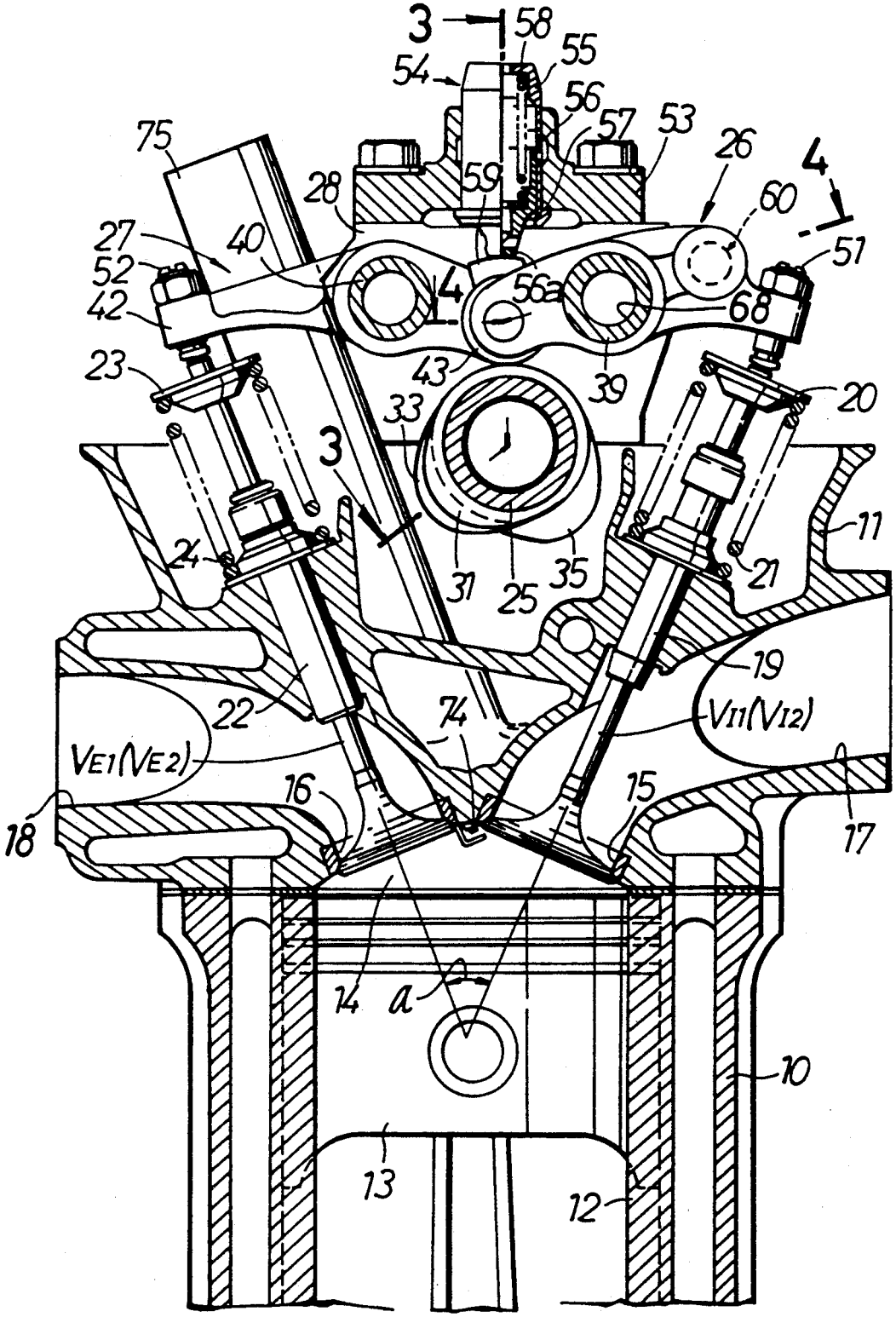
FIG. 1 is a longitudinal sectional side view of an essential portion of an internal combustion engine including a valve operating system, taken along a line 1—1 in FIG. 2.

Referring first to FIG. 1, an essential portion of an engine body in a single overhead cam (SOHC) type multicylinder internal combustion engine is comprised of a cylinder block 10 and a cylinder head 11 coupled to an upper surface of the cylinder block 10. A piston 13 is slidably received in each of a plurality of cylinders 12 formed side by side in the cylinder block 10. A combustion chamber 14 is defined between an upper surface of each of the pistons 13 and the cylinder head 11.

A pair of intake valve bores 15 and a pair of exhaust valve bores 16 are provided in the cylinder head 11 in such a manner that they are opened into a ceiling surface of each of the combustion chambers 14. The intake valve bores 15 are connected to a single intake port 17 opened into one side of the cylinder head 11, and the exhaust valve bores 16 are connected to a single exhaust port 18 opened into the other side of the cylinder head 11. A pair of intake valves $V_{I1}$ and $V_{I2}$ capable of independently opening and closing the intake valve bores 15 are slidably received in a pair of cylindrical guides 19 disposed in the cylinder head 11. A coiled valve spring 21 is interposed between the cylinder head 11 and a retainer 20 to surround each of the intake valves $V_{I1}$ and $V_{I2}$. The retainer 20 is fixed to an upper end of each of the intake valves $V_{11}$ and $V_{12}$ that projects from the corresponding cylindrical guide 19. Each of the intake valves $V_{I1}$ and $V_{I2}$ is biased upwardly, i.e., in a valve-closing direction by the valve spring 21. A pair of exhaust valves $V_{E1}$ and $V_{E2}$ capable of independently opening and closing the exhaust valve bores 16 are slidably received in a pair of cylindrical guides 22 disposed in the cylinder head 11. A coiled valve spring 24 is interposed between the cylinder head 11 and a retainer 23 to surround each of the exhaust valves $V_{E1}$ and $V_{E2}$. The retainer 23 is fixed to an upper end of each of the exhaust valves $V_{E1}$ and $V_{E2}$ is that projects from the corresponding cylindrical guide 22. Each of the exhaust valves $V_{E1}$ and $V_{E2}$ are biased upwardly, i.e., in a valve closing direction by the spring 24.

Figure 2:
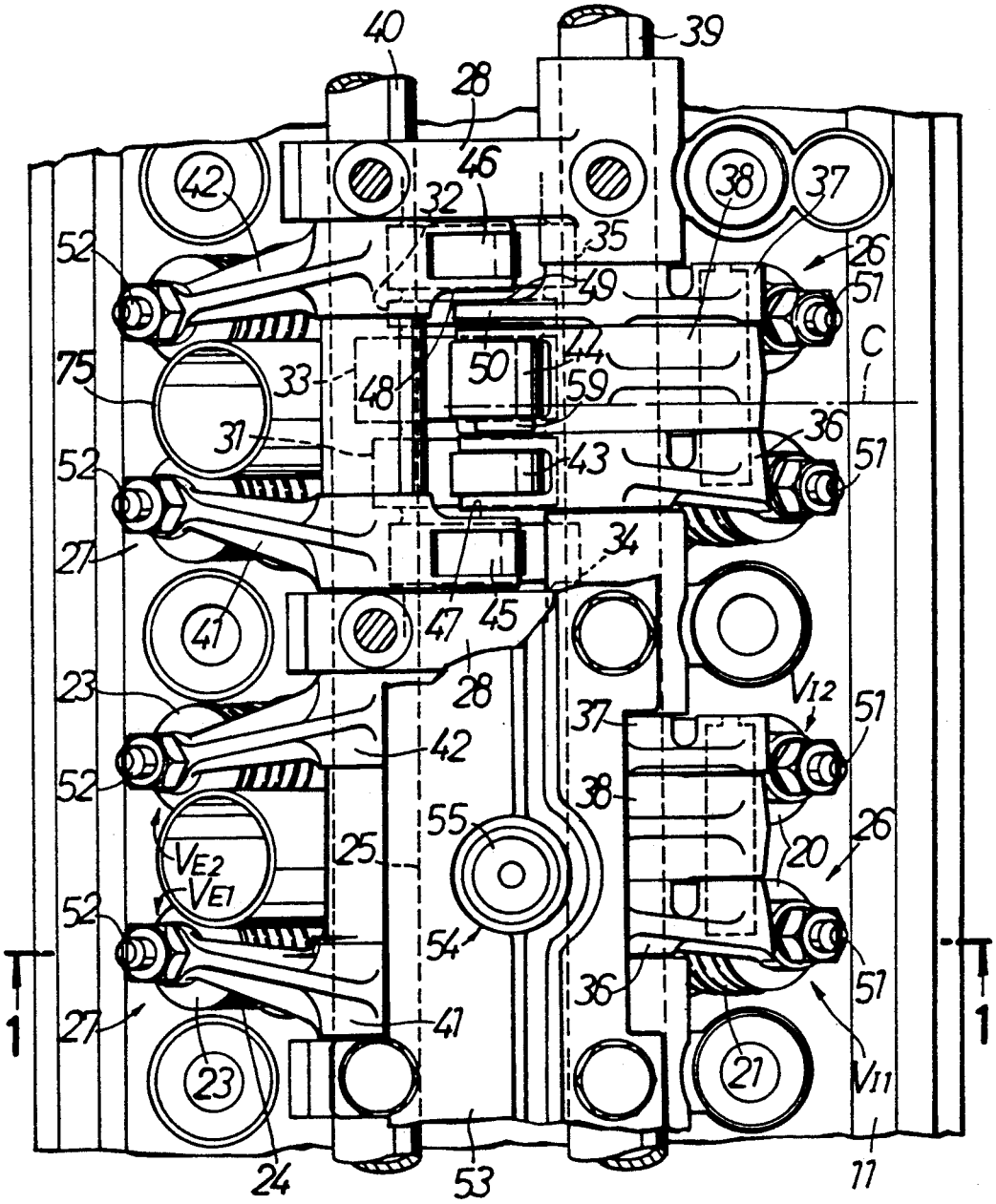
FIG. 2 is a partially cutaway plan view of the essential portion of the engine shown in FIG. 1.
Figure 3:
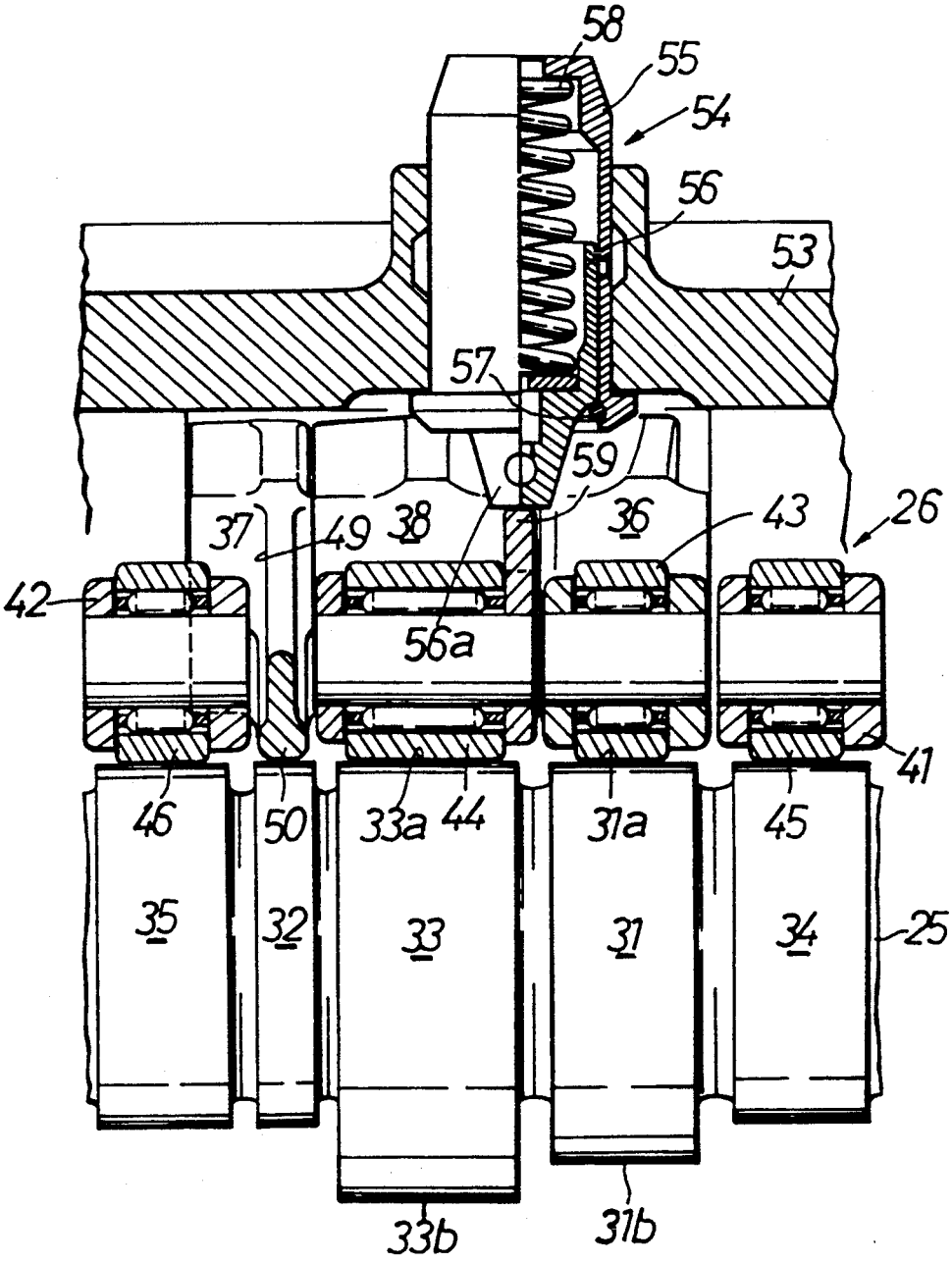
FIG. 3 is an enlarged sectional view taken along a line 3—3 in FIG. 1.
Figure 4:
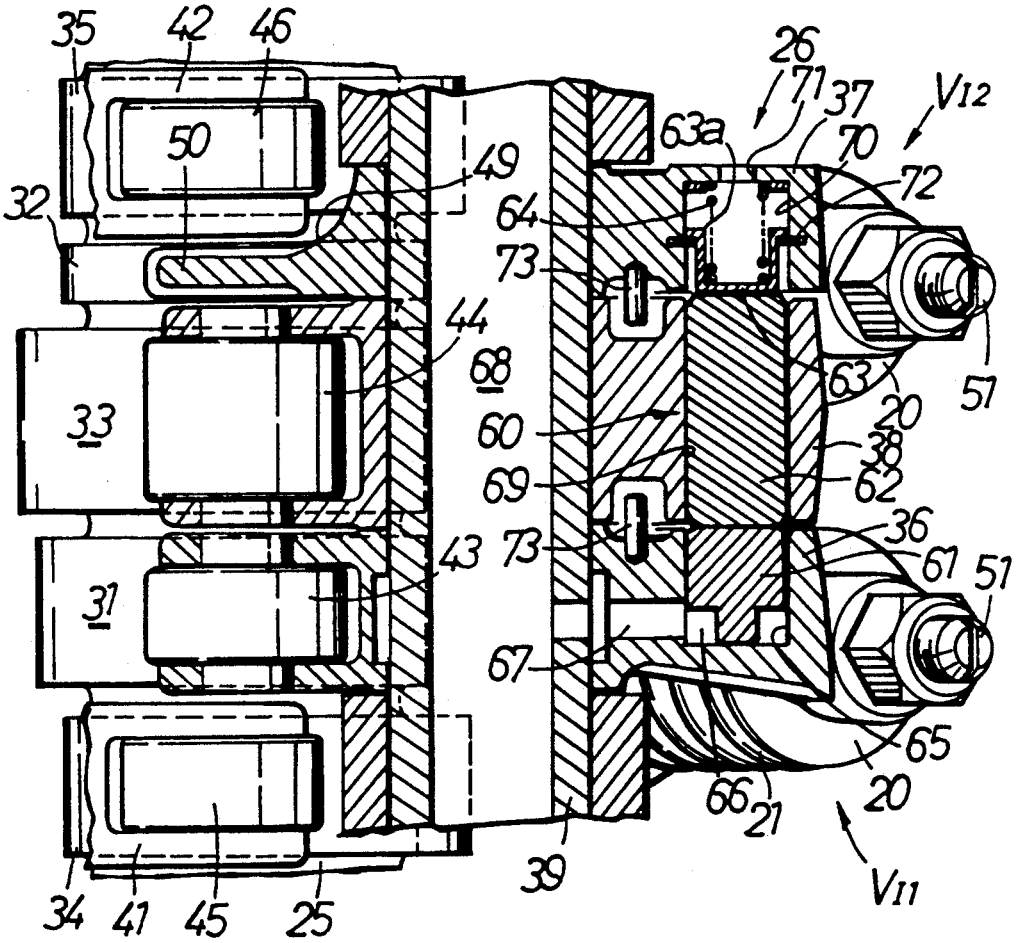
FIG. 4 is an enlarged sectional view taken along a line 4—4 in FIG. 1.

Referring also to FIGS. 2, 3 and 4, intake valve driving means 26 is interposed between a single cam shaft 25 operatively connected to a crankshaft (not shown) at a reduction ratio of ½ and each of the intake valves $V_{I1}$ and $V_{I2}$ for every cylinder 12. The intake valve driving means 26 is adapted to convert the rotational motion of the cam shaft 25 into an opening and closing motion of each of the intake valves $V_{I1}$ and $V_{I2}$. Exhaust valve driving means 27 is interposed between the cam shaft 25 and each of the exhaust valves $V_{E1}$ and $V_{E2}$ for every cylinder 12. The exhaust valve driving means 27 is adapted to convert the rotational motion of the cam shaft 25 into an opening and closing motion of each of the exhaust valves $V_{E1}$ and $V_{E2}$.

The cam shaft 25 is rotatably supported by the cylinder head 11 and a holder 28 coupled to the cylinder head 11 and has a horizontal axis perpendicular to the axis of each cylinder 12. As is clearly shown in FIG. 3, first and second intake-side cams 31 and 32 and a third intake-side cam 33 therebetween are integrally provided on the cam shaft 25 in correspondence to each cylinder 12. The first intake-side cam 31 is intended to open and close the intake valve $V_{I1}$ mainly during operation of the engine at a low speed and includes a circular base portion 31*a* uniformly spaced from the center of the cam shaft 25, and a lobe portion 31*b* projecting radially outwardly from the circular base portion 31*a*. The second intake-side cam 32 is intended to bring the intake valve $V_{I2}$ into a substantially inoperative state mainly during operation of the engine at a low speed and is provided on the cam shaft 25 with an axially reduced width and a substantially circular contour corresponding to the circular base portion 31*a* of the first intake-side cam 31. It should be noted that at a portion corresponding to the lobe portion 31*b* of the first intake-side cam 31, the second intake-side cam 32 is provided with a projection slightly protruding radially outwardly. The third intake-side cam 33 is intended to open and close the intake valves $V_{I1}$ and $V_{I2}$ mainly during operation of the engine at a high speed and includes a circular base portion 33*a* corresponding to the circular base portion 31*a* of the first intake-side cam 31, and a lobe portion 33*b* projecting outwardly radially of the cam shaft 25 from the circular base portion 33*a* at an amount larger than that of the lobe portion 31*b* of the first intake-side cam 31 and over a rotational angle wider than that of the lobe portion 31*b*.

First and second exhaust-side cams 34 and 35 are integrally provided on the cam shaft 25 in correspondence to each cylinder 12 so as to sandwich the first, second and third intake-side cams 31, 32 and 33 therebetween from opposite sides. The exhaust-side cams 34 and 35 each have a shape suitable for opening and closing the exhaust valves $V_{E1}$ and $V_{E2}$, suitable for all the operational conditions of the engine.

The intake valve driving means 26 comprises a first intake-side rocker arm 36 operatively connected to one of the intake valves $V_{I1}$ a second intake-side rocker arm 37 operatively connected to the other intake valves $V_{I2}$, and a third intake-side rocker arm 38 adjacently disposed between the first and second intake-side rocker arms 36 and 37 but not directly connected to either intake value. The rocker arms 36, 37 and 38 are swingably carried on an intake-side rocker shaft 39 which is fixedly supported on the holder 28 above and laterally of the cam shaft 25 and has an axis parallel to the cam shaft 25. The exhaust valve driving means 27 comprises first and second rocker arms 41 and 42 operatively connected independently to the exhaust valves $V_{E1}$ and $V_{E2}$. The first and second exhaust-side rocker arms 41 and 42 are swingably carried on an exhaust-side rocker shaft 40 which is fixedly supported on the holder 28 above and laterally of the cam shaft 25 in parallel to the cam shaft 25.

A roller 43 is supported by a pin at one end of the first intake-side rocker arm 36 to come into rolling contact with the first intake-side cam 31, and a roller 44 is supported by a pin at one end of the third intake-side rocker arm 38 to come into rolling contact with the third intake-side cam 33. Further, rollers 45 and 46 are each supported by a pin at one end of the first and second exhaust-side rocker arms 41 and 42 to come into rolling contact with the first and second exhaust-side cams 34 and 35, respectively.

Moreover, referring to FIG. 2, the first and second exhaust-side rocker arms 41 and 42 are provided, on opposed sides at one end thereof, with notches 47 and 48 for accommodating portions of one end of the first and second intake-side rocker arms 36 and 37 adjacent thereto. Similarly, the second intake-side rocker arm 37 is provided, at the side end portion thereof opposed to the adjacent second exhaust-side rocker arm 42, with a notch 49 which accommodates a portion of the one end of the second exhaust-side rocker arm 42, and with a slipper 50 having a reduced width compared to the second intake-side cam 32 and positioned to come into sliding contact with the second intake-side cam 32. As is clearly shown in FIG. 2, the notch 48 in the second exhaust rocker arm 42 and the notch 49 in the second intake-side rocker arm 37 are disposed in an opposed relation to each other, so that the remaining portions of each of the rocker arms 42 and 37 are disposed in an overlapped manner in the axial direction of the cam shaft 25.

A tappet screw 51 is threadedly mounted in the other end of each of the first and second intake-side rocker arms 36 and 37 to abut against the upper end of the corresponding one of the intake valves $V_{I1}$ and $V_{I2}$ for conventional lash adjustment. The intake valves $V_{I1}$ and $V_{I2}$ are operated for opening and closing in accordance with the swinging movement of the first and second intake-side rocker arms 36 and 37, respectively. A tappet screw 52 is threadedly mounted in the other end of each of the first and second exhaust-side rocker arms 41 and 42 to abut against the upper end of the corresponding one of the exhaust valves $V_{E1}$ and $V_{E2}$ for each adjustment. The exhaust valves $V_{E1}$ and $V_{E2}$ are operated for opening and closing in accordance with the swinging movement of the first and second exhaust-side rocker arms 41 and 42, respectively.

A support plate 53 is fixed on the holders 28 that are located between adjacent cylinders 12 for the support plate to extend over the cylinders and above the camshaft 25. The support plate 53 is provided with a lost motion mechanism 54 for resiliently biasing the third intake-side rocker arm 38 toward the third intake-side cam 33 for inhibiting bouncing of the rocker arm 38 on cam 33.

The lost motion mechanism 54 includes a bottomed cylindrical guide member 55 fitted in the support plate 53 and an urging member 56 slidably received in the guide member 55. The urging member 56 is provided, at an end thereof adjacent the third intake-side rocker arm 38, with a tapered abutment 56*a* which abuts against the rocker arm 38. A stopper 57 is detachably secured to an inner surface of the guide member 55 adjacent the downwardly facing opening therein to engage the urging member 56. A spring 58 is interposed between the urging member 56 and the guide member 55 to resiliently bias the urging member 56 in a direction to bring it into abutment against the third intake-side rocker arm 38.

A projection 59 is provided in an upwardly protruding manner at one end of the third intake-side rocker arm 38 to abut against the abutment 56*a* of the urging member 56 of the lost motion mechanism 54. It is to be noted that the projection 59 is provided on either side of the roller 44 because the roller 44 is centrally has been supported by the pin at one end of the third intake-side rocker arm 38. In the present embodiment, the projection 59 is provided at one end of the third intake-side rocker arm 38 on the side of the roller 44 closer to a center line C (see FIG. 2) between the pair of intake valves $V_{I1}$ and $V_{I2}$.

Referring more particularly to FIG. 4, the intake valve driving means 26 is provided with a connection switchover mechanism 60 which is capable of switching-over the connection and disconnection of the intake-side rocker arms 36, 37 and 38 in accordance with the operational condition of the engine. The connection switchover mechanism 60 comprises a connecting piston 61 capable of connecting the first and third intake-side rocker arms 36 and 38, a connecting pin 62 capable of connecting the third and second intake-side rocker arms 38 and 37, a restraining member 63 for restraining the movement of the connecting piston 61 and the connecting pin 62, and a return spring 64 for biasing the connecting piston 61, the connecting pin 62 and the restraining member 63 in a connection releasing direction.

The first intake-side rocker arm 36 has a first bottomed guide hole 65 provided therein in parallel to the intake-side rocker shaft 39 and opened toward the third intake-side rocker arm 38. The connecting piston 61 is slidably received in the first guide hole 65, so that a hydraulic pressure chamber 66 is defined between one end of the connecting piston 61 and a closed end of the first guide hole 65. A communication passage 67 is provided in the first intake-side rocker arm 36 to communicate with the hydraulic pressure chamber 66, and a hydraulic pressure supply passage 68 is provided in the intake-side rocker shaft 39 to lead to a hydraulic pressure supply source which is not shown. The hydraulic pressure supply passage 68 normally communicates with the communication passage 67 and thus the hydraulic pressure chamber 66, despite the swinging movement of the first intake-side rocker arm 36.

A guide hole 69 is provided in the third intake-side rocker arm 38 in parallel to the intake-side rocker shaft 39 in correspondence to the first guide hole 65 to extend between opposite side surfaces thereof. The connecting pin 62 having its one end abutting against the other end of the connecting piston 61 is slidably received into the guide hole 69.

A second bottomed guide hole 70 is provided in the second in take-side rocker arm 37 in parallel to the intake-side rocker shaft 39 in correspondence to the guide hole 69 and opened toward the third intake-side rocker arm 38. The bottomed cylindrical restraining member 63 abutting against the other end of the connecting pin 62 is slidably received in the guide hole 70. The restraining member 63 is disposed with its open end directed toward the closed end of the second guide hole 70. A collar 63*a* projects radially outwardly at the open end of the restraining member 63 to come into sliding contact with an inner surface of the second guide hole 70. The return spring 64 is mounted in a compressed manner between the closed end of the second guide hole 70 and the closed end of the restraining member 63. The connecting piston 61, the connecting pin 62 and the restraining member 63 abutting against one another are biased toward the hydraulic pressure chamber 66 by a resilient force of the return spring 64. Moreover, the closed end of the second guide hole 70 is provided with a communication hole 71 for venting air and oil.

A retaining ring 72 is fitted to an inner surface of the second guide hole 70 and engageable with the collar 63*a* of the restraining member 63. The retaining ring 72 prevents the restraining member 63 from slipping out of the second guide hole 70.

In such connection switchover mechanism 60, a spring pin 73 is provided on each of the side surfaces of the first and second intake-side rocker arms 36 and 37 facing the third intake-side rocker arm 38 and is adapted to engage the third intake-side rocker arm 38 upon extreme relative swinging movement, while permitting the normal swinging movement of the first and second intake-side rocker arms 36 and 37 relative to the third intake-side rocker arm 38 during valve operation. The spring pins 73 serves to inhibit the connecting piston 61 and the connecting pin 62 from falling out of the first and third intake-side rocker arms 36 and 38 in the condition in which the intake-side rocker arms 36, 37 and 38 have been assembled on the intake-side rocker shaft 39 but before those rocker arms are confined by the cam shaft 25 and valves.

A spark plug 74 is disposed at a central portion of a ceiling surface of the combustion chamber 14. A plug pipe 75 for inserting the spark plug 74 is disposed in the cylinder head 11. The first and second exhaust-side rocker arms 41 and 42 are disposed to come into contact with the first and second exhaust-side cams 34 and 35 of the cam shaft 25 on opposite sides of the first, second and third intake-side rocker arms 36, 37 and 38 which are disposed adjacent one another. This enables a relatively wide space to be insured between the exhaust-side rocker arms 41 and 42 and also enables the exhaust valves $V_{E1}$ and $V_{E2}$ to be disposed at a relatively large distance spaced from each other. Therefore, the plug pipe 75 is disposed in the cylinder head 11 with its axis disposed between the axes of the exhaust valves $V_{E1}$ and $V_{E2}$, i.e., so as to lie between both the exhaust valves $V_{E1}$ and $V_{E2}$ as well as between both the exhaust-side rocker arms 41 and 42. The spark plug 74 inserted into the plug pipe 75 is screwed into the cylinder head 11 to face the central portion of the ceiling surface of the combustion chamber 14.

The operation of this embodiment now will be described. In the intake valve driving means 26, the hydraulic pressure in the hydraulic pressure chamber 66 in the connection switchover mechanism 60 is released during operation of the engine at a low speed. As a result, the connecting piston 61, the connecting pin 62 and the restraining member 63 are in their disconnected states, as shown in FIG. 4, in which they have been moved to the maximum extend toward the hydraulic pressure chamber 66 by the spring force of the return spring 64. In this condition, the abutment surfaces of the connecting piston 61 and the connecting pin 62 are in a location between the first and third intake-side rocker arms 36 and 38, and the abutment surfaces of the connecting pin 62 and the restraining member 63 are in a location between the third and second intake-side rocker arms 38 and 37. Therefore, the rocker arms 36, 37 and 38 are in their states in which they can be displaced angularly relative to one another.

In such disconnected condition, the first intake-side rocker arm 36 is swung in response to the sliding contact with the first intake-side cam 31 by the rotation of the cam shaft 25, so that one of the intake valves $V_{I1}$ is opened and closed with a timing and a lift amount depending upon the shape of the first intake-side cam 31. On the other hand, the second intake-side rocker arm 37 is in its substantially resting state in response to the sliding contact with the second intake-side cam 32, and the other intake valve $V_{I2}$ becomes substantially inoperative. In this case, the third intake-side rocker arm 38 will be swung in response to the rolling contact with the third intake-side cam 33, but such a swinging movement exerts no influence on the first and second intake-side rocker arms 36 and 37. In addition, the exhaust valves $V_{E1}$ and $V_{E2}$ are opened and closed with a timing and a lift amount depending upon the shapes of the first and second exhaust-side cams 34 and 35.

During operation of the engine at a high speed, a high hydraulic pressure is supplied to the hydraulic pressure chamber 66. This causes the connecting piston 61, the connecting pin 62 and the restraining member 63 in the connection switchover mechanism 60 of the intake valve driving means 26 to be moved to their connected positions against the spring force of the return spring 64. As a result, the connecting piston 61 is received into the guide hole 69, while the connecting pin 62 is received into the second guide hole 70, thereby causing the intake-side rocker arms 36, 37 and 38 to be connected together. During this time, the amount of swinging movement of the third intake-side rocker arm 38 in rolling contact with the third intake-side cam 33 is largest and hence, the first and second intake-side rocker arms 36 and 37 are swung in unison with the third intake-side rocker arm 38, so that the intake valves $V_{I1}$ and $V_{I2}$ are opened and closed with a timing and a lift amount depending upon the shape of the third intake-side cam 33.

During the operation of the engine at the high speed, the first and second exhaust-side rocker arms 41 and 42 in the exhaust valve driving means 27 continue to cause the exhaust valves $V_{E1}$ and $V_{E2}$ to be opened and closed with a timing and a lift amount depending upon the shapes of the first and second exhaust-side cams 34 and 35.

By changing the opening and closing mode of the intake valves $V_{I1}$ and $V_{I2}$ between the operation of the engine at a high speed and the operation of the engine at a low speed, a valve-operating characteristic suitable to the operation of engine can be established, thereby providing an enhanced output from the engine.

In such an internal combustion engine, the first, second and third intake-side rocker arms 36, 37 and 38 are disposed adjacent one another in an appropriate position corresponding to the cam shaft 25, and therefore, they can be disposed in a compact arrangement. As a result, the connection switchover mechanism 60 is arranged in a compact construction, thereby not only enabling the dimensional accuracy of the components of the connection switchover mechanism 60 to be easily improved in order to provide a smooth operation of the connection switchover mechanism 60, but also contributing a reduction in the weight of the intake-side rocker arms 36, 37 and 38.

By efficiently using the space resulting from the disposition of the first and second exhaust-side rocker arms 41 and 42 on the opposite sides of the intake valve driving means 26, the plug pipe 75 is disposed in the cylinder head 11, so that its axis is located between the axes of the exhaust valves $V_{E1}$ and $V_{E2}$, leading to a compact arrangement of the entire system.

Moreover, the first and third intake-side rocker arms 36 and 38 are in rolling contact with the first and third intake-side cams 31 and 33 through the rollers 43 and 44, and the first and third exhaust-side rocker arms 41 and 42 are in rolling contact with the first and third exhaust-side cams 34 and 35 through the rollers 45 and 46, thereby making it possible to reduce the loss of valve-operating friction to the utmost.

Further, since the notches 47 and 48 for accommodating portions of one end of the adjacent first and second intake-side rocker arms 36 and 37 are provided in the opposed sides of one end of the first and second exhaust-side rocker arms 41 and 42, the intake-side rocker arms 36, 37 and 38 and the exhaust-side rocker arms 41 and 42 can be disposed adjacent one another in a direction along the axis of the cam shaft 25 with the total axial dimension reduced suppressed significantly to a short amount, while avoiding the mutual interference between the first and second intake-side rocker arms 36 and 37 and the first and second exhaust-side rocker arms 41 and 42, despite the use of the four rollers 43, 44, 45 and 46. In addition to this, it is possible to reduce the distance between the intake-side rocker shaft 39 and the exhaust-side rocker shaft 40, and to diminish, to the utmost, the angle $\alpha$ (see FIG. 1) formed by the axes of the intake valves $V_{I1}$ and $V_{I2}$ and the exhaust valves $V_{E1}$ and $V_{E2}$ projected on a plane including the axis of the cylinder 12, thereby providing an improvement in combustibility in the combustion chamber 14.

Yet further, by reducing the width of the second intake-side cam 32 as well as the slipper 50 in sliding contact with the second intake-side cam 32 and by providing the notch 49 for accommodating a portion of the one end of the second exhaust-side rocker arm 42 at the one end of the second intake-side rocker arm 37, the intake-side rocker arms 36, 37 and 38 and the exhaust-side rocker arms 41 and 42 are disposed adjacent one another in a very compact arrangement.

The lost motion mechanism 54 serves to bias the third intake-side rocker arm 38 toward the third intake-side cam 33 in the position proximate to the center line between the pair of intake valves $V_{I1}$ and $V_{I2}$. In the present embodiment, when the connection switchover mechanism 60 has been brought into the connecting state, the distances from the point of application of the force from the third intake-side cam 33 to the third intake-side rocker arm 38 and then to the intake valves $V_{I1}$ and $V_{I2}$ is substantially equalized and therefore, the opening and closing behavior of the intake valves $V_{I1}$ and $V_{I2}$ can be stabilized with no need for an increase in load of the valve springs 21. This also contributes to a reduction in loss of valve-operationing friction.

Figure 5:
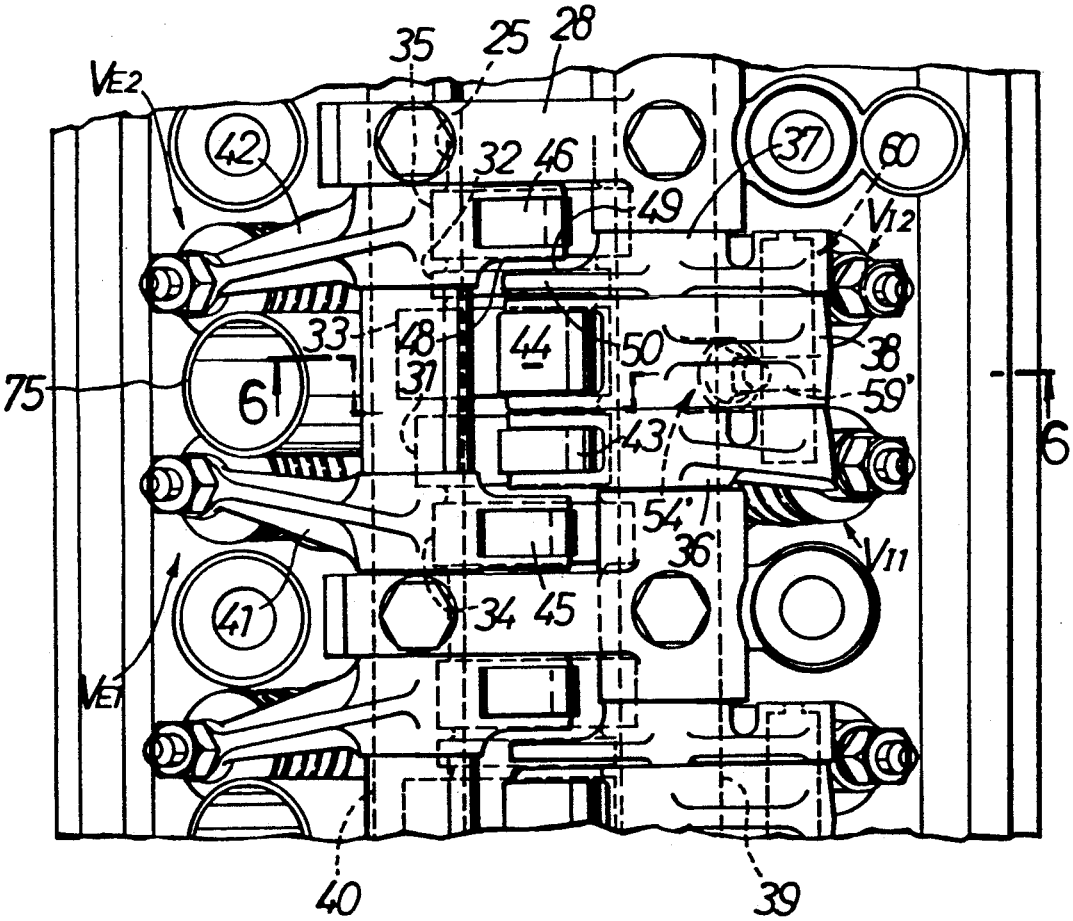
FIG. 5 is a plan view similar to FIG. 2, but illustrating a modification of a lost motion mechanism.
Figure 6:
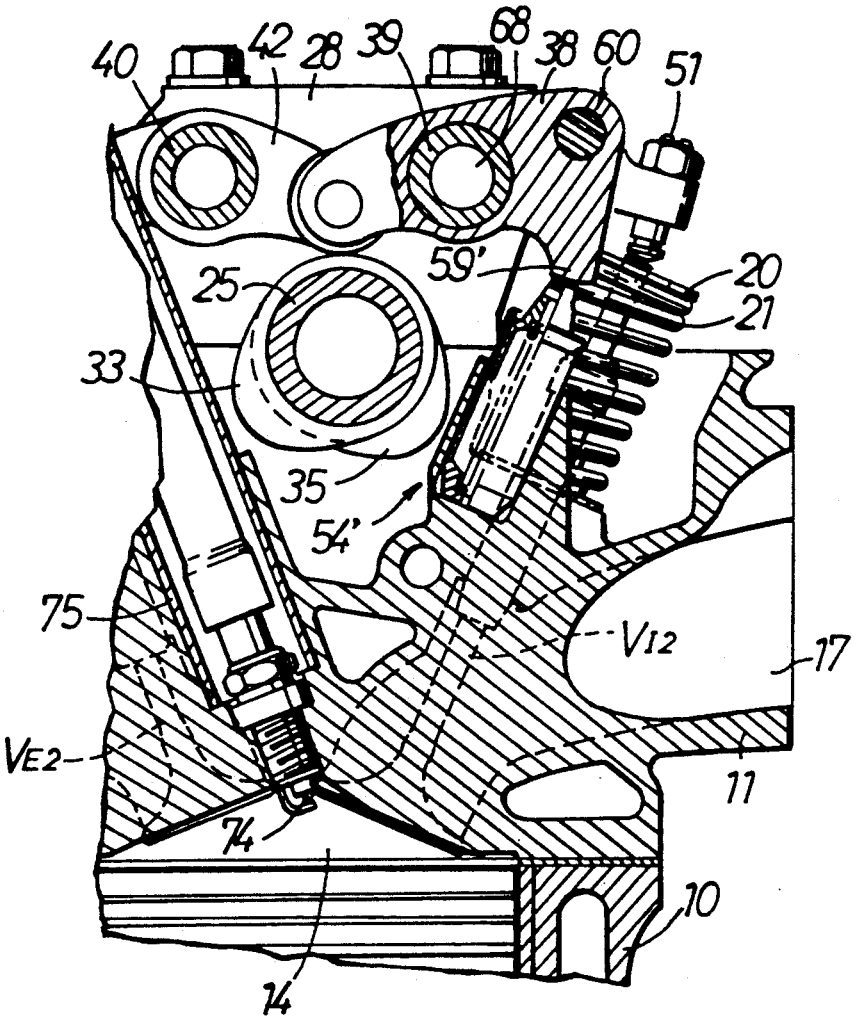
FIG. 6 is a sectional view taken along a line 6—6 in FIG. 5.

FIGS. 5 and 6 illustrate a modification of the lost motion mechanism 54'. The lost motion mechanism 54' is provided in the cylinder head 11 at a substantially central location between the intake valves $V_{I1}$ and $V_{I2}$ for producing a resilient upward force. A projection 59' for receiving the resilient force from the lost motion mechanism 54' is provided in a downwardly protruding fashion on a third intake-side rocker arm 38' which is swingably carried on the intake-side rocker shaft 39 between the first and second intake-side rocker arms 36 and 37. The remaining components of the valve operating system remain the same and a numbered the same. Even in this modification, the beneficial effects similar to those in the previously described embodiment can be provided.

What is claimed is:

1. A valve operating system in an internal combustion engine, comprising first, second and third intake-side cams and first and second exhaust-side cams all provided on a single cam shaft for correspondence to a cylinder of the engine, first and second intake-side rocker arms operatively connected independently to a pair of intake valves for the cylinder and a third intake-side rocker arm disposed between the first and second intake-side rocker arms, which arms are swingably carried on an intake-side rocker shaft for engagement with said first, second and third intake-side cams, respectively, first and second exhaust-side rocker arms operatively connected independently to a pair of exhaust valves for the cylinder and swingably carried on an exhaust-side rocker shaft for engagement with said first and second exhaust-side cams, respectively, and a connection switchover mechanism provided on the intake-side rocker arms and capable of switching-over the connection and disconnection of the adjacent intake-side rocker arms, wherein said first to third intake-side cams are provided adjacent one another in an axial direction on said cam shaft, said first, second and third intake-side rocker arms are disposed between said first and second exhaust-side rocker arms, and at least two of said first, second and third intake-side rocker arms, as well as said first and second exhaust-side rocker arms, are in rolling contact with the corresponding cams through rollers, said first and second exhaust-side rocker arms being provided with notches for accommodating portions of said first and second intake-side rocker arms, respectively.

2. A valve operating system in an internal combustion engine according to claim 1, wherein said second intake-side cam corresponding to said second intake-side rocker arm has an outer surface substantially circular about an axis of the cam shaft, the second intake-side cam having a substantially narrow width in an axial direction, and said second intake-side rocker arm is provided with a notch for accommodating a portion of said second exhaust-side rocker arm and with a slipper having a small width to come into direct sliding contact with said second intake-side cam.

3. A valve operating system in an internal combustion engine according to claim 1, further including a lost motion mechanism provided in proximity to a center line between said pair of intake valves.

4. A valve operating system in an internal combustion engine according to claim 3, wherein said lost motion mechanism is associated with said third intake-side rocker arm, which is disposed in the middle.

5. A valve operating system in an internal combustion engine according to claim 1, further including a plug pipe for a spark plug, which plug pipe is disposed between said pair of exhaust valves and between said first and second exhaust-side rocker arms.

6. In a valve operating system for a multicylinder overhead cam type internal combustion engine having first, second and third intake-side cams and first and second exhaust-side cams all provided on a single cam shaft positioned above at least one cylinder, first and second intake-side rocker arms operatively connected independently to a pair of intake valves for the cylinder and a third intake-side rocker arm disposed between the first and second intake-side rocker arms, which arms are swingably carried on an intake-side rocker shaft for engagement with said first, second and third intake-side cams, respectively, first and second exhaust-side rocker arms operatively connected independently to a pair of exhaust valves for the cylinder and swingably carried on an exhaust-side rocker shaft for engagement with said first and second exhaust-side cams, respectively, a connection switchover mechanism provided on the intake-side rocker arms and capable of switching-over the connection and disconnection of the adjacent intake-side rocker arms, said first to third intake-side cams are provided adjacent one another in an axial direction on said cam shaft, said first, second and third intake-side rocker arms are disposed between said first and second exhaust-side rocker arms, and at least two of said first, second and third intake-side rocker arms, as well as said first and second exhaust-side rocker arms are provided with rollers for rolling contact with the corresponding cams, and improvement comprising, said first and second exhaust-side rocker arms being provided with axial notches reducing their width in the axial direction of the camshaft near the camshaft for accommodating portions of said first and second intake-side rocker arms, respectively, near the camshaft and reducing the overall width of the combined rocker arms in said axial direction.

7. A valve operating system according to claim 6, wherein said second intake-side cam corresponding to said second intake-side rocker arm has an outer surface substantially circular about an axis of the cam shaft, the second intake-side cam having a substantially narrow width in an axial direction, and said second intake-side rocker arm is provided with an axial notch for accommodating an axial portion of said second exhaust-side rocker arm for further reducing the combined axial width of the rocker arms.

8. A valve operating system according to claim 7, wherein said second intake-side rocker arm is provided with a slipper for engaging said second intake-side cam, said slipper having a narrow width in the axial direction.

9. A valve operating system according to claim 6, further including a plug pipe for a spark plug, which plug pipe is disposed between said pair of exhaust valves and between said first and second exhaust-side rocker arms.

* * * * *